US011623365B2

(12) United States Patent
Boeckmann et al.

(10) Patent No.: US 11,623,365 B2
(45) Date of Patent: Apr. 11, 2023

(54) DEVICE FOR STORING OBJECTS, IN PARTICULAR FOR CURING OBJECTS MADE OF CONCRETE, UNDER DEFINED TEMPERATURE CONDITIONS AND HUMIDITY CONDITIONS

(71) Applicant: Kraft Curing Systems GmbH, Lindern (DE)

(72) Inventors: Marius Boeckmann, Peheim (DE); Waldemar Ron, Cloppenburg (DE)

(73) Assignee: KRAFT CURING SYSTEMS GMBH, Lindern (DE)

( * ) Notice: Subject to any disclaimer, the term of this patent is extended or adjusted under 35 U.S.C. 154(b) by 219 days.

(21) Appl. No.: 16/568,788

(22) Filed: Sep. 12, 2019

(65) Prior Publication Data

US 2020/0078985 A1 Mar. 12, 2020

(30) Foreign Application Priority Data

Sep. 12, 2018 (DE) ..... 10 2018 122 196.7

(51) Int. Cl.
*B28B 11/24* (2006.01)

(52) U.S. Cl.
CPC ..... *B28B 11/247* (2013.01); *B28B 11/245* (2013.01)

(58) Field of Classification Search
CPC ..... B28B 11/247; B28B 11/245
(Continued)

(56) References Cited

U.S. PATENT DOCUMENTS 1,441,661 A * 1/1923 Church ..... F26B 15/14 198/435
1,492,188 A * 4/1924 Young ..... F26B 25/18 165/80.5

(Continued)

FOREIGN PATENT DOCUMENTS

CN 204229630 U * 3/2015
CN 107144100 A 9/2017

(Continued)

OTHER PUBLICATIONS

Machine translation CN204229630U (Year: 2015).*

(Continued)

*Primary Examiner* — Matthew J Daniels
*Assistant Examiner* — Wayne K. Swier
(74) *Attorney, Agent, or Firm* — Muncy, Geissler, Olds & Lowe, P.C.

(57) ABSTRACT

The invention relates to a device for storing objects under defined temperature conditions and humidity conditions. In particular, the invention relates to a device for curing objects made of concrete. The device has a shelving system having a plurality of shelf supports and a plurality of bearing elements for supporting shelves supported on the shelf supports and arranged one above the other in a plurality of levels, on which shelves the objects are stored. According to the invention, a flow pipe system for distributing supply air provided in a climate system is at least partially integrated into the shelving system. A plurality of shelf supports in this case are at least in sections at the same time downward pipelines of the flow pipe system that the provided supply air is able to flow through. As a result, condensation at the foot of the shelving system and thus corrosion is counteracted at the shelf supports, thus increasing the service life of the shelving system.

16 Claims, 6 Drawing Sheets

(58) Field of Classification Search
USPC ..... 312/31.1
See application file for complete search history.

(56) References Cited

U.S. PATENT DOCUMENTS

| | | | | | |
|---|---|---|---|---|---|
| 1,969,126 | A * | 8/1934 | Forse | F27D 5/0006 | 432/258 |
| 2,995,257 | A * | 8/1961 | Blaise | A47B 57/34 | 211/208 |
| 4,244,904 | A * | 1/1981 | Drain | B28B 11/245 | 264/333 |
| 4,772,439 | A * | 9/1988 | Trevino-Gonzalez | B28B 11/245 | 264/40.6 |
| 2005/0235518 | A1* | 10/2005 | Binder | B08B 3/02 | 34/202 |
| 2018/0120022 | A1* | 5/2018 | Rindlisbach | F25D 23/069 | |

FOREIGN PATENT DOCUMENTS

| | | | | |
|---|---|---|---|---|
| GB | 190709752 | A * | 8/1907 | |
| GB | 126813 | A * | 5/1919 | |
| JP | H09360 | A * | 1/1997 | |
| JP | H107208 | A * | 1/1998 | A47B 63/00 |
| JP | 2001-095632 | A | 4/2001 | |
| JP | 2001095632 | A * | 4/2001 | |
| JP | 2015-190678 | A | 11/2015 | |

OTHER PUBLICATIONS

Machine translation JPH09360A cited in JP20010956332A (Year: 1997).*

Machine translation JPH107208A (Year: 1998).*

Kraft; Kraft Curing Systems; "Van Dyk Stene invests in fully automated concrete products plant with integrated curing system"; https://www.kraftcuring.com/wp-content/uploads/2019/10/1504-kraftcuring-vandyk-en.pdf; Kraft Curing Systems GmbH, 49699 Lindern, Deutschland; Apr. 2015; 5 pages (XP-055646330).

Kraft; Kraft Curing Systems; "Convect-Air® Accelerated Precast Concrete Curing System Reduced Curing Duration Via Warm Air Circulation How It Works Concrete Shouldn't Dry It Should Harden!"; https://cdn.tne-cms.com/2667-6be07de2-0bbd-4175-b958-e213a5cf8aee-convectair+brochure+english.pdf, Kraft Curing Systems GmbH, 49699 Lindern, Deutschland; Oct. 2016; 2 pages (XP-055646399).

Kraft; Kraft Curing Systems; "QUADRIX System"; https://cdn.tne-ems.com/2657-72384d04-8058-46df-a034-69c49235d311-quadrix+brochure+english.pdf, Kraft Curing Systems GmbH, 49699 Lindern, Deutschland; Oct. 2016; 2 pages (XP-055646406).

Rick, Stefan; Kraft Curing Systems—"Härtungsregale made in Germany mit computer-optimiertem Design und integrierter Klimatisierung"; https://www.cpi-worldwide.com/uploads/journals/pdf/2018/05/de/de__05_2018_104_107.pdf; Kraft Curing Systems GmbH, 49699 Lindern, Deutschland; May 2018; 4 pages (XP-055646352).

* cited by examiner

Fig. 8
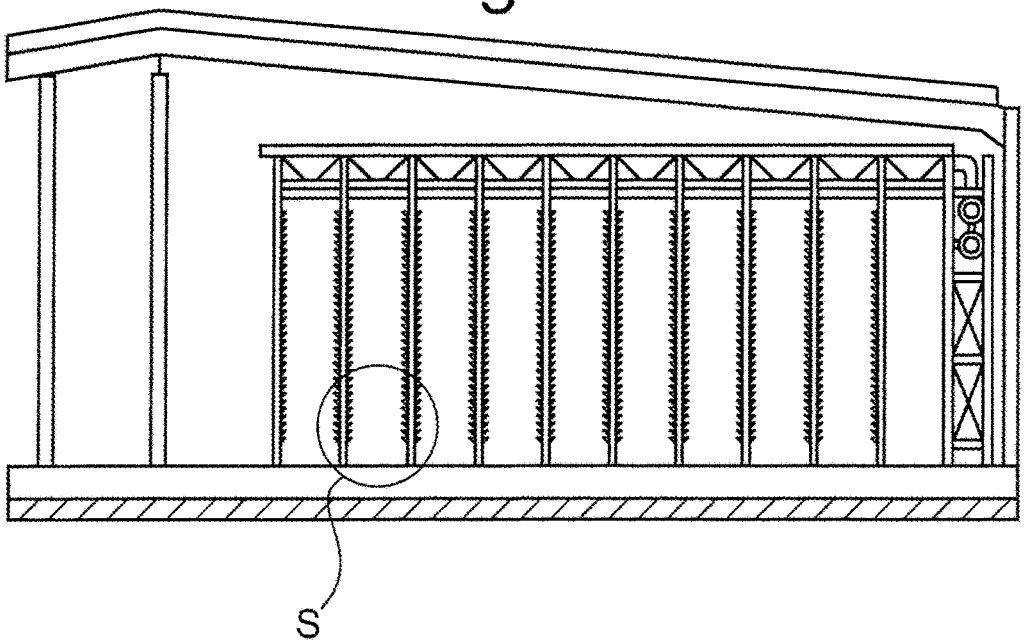
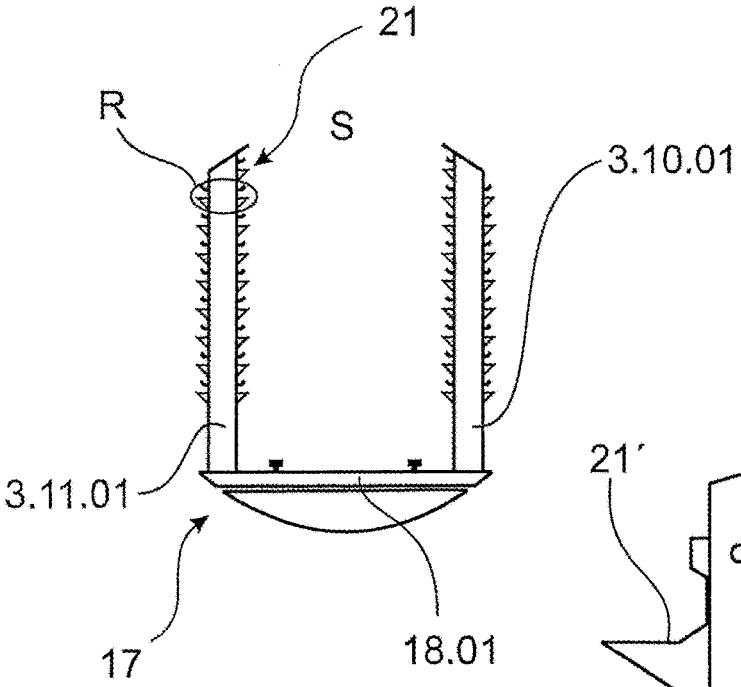
Fig. 9
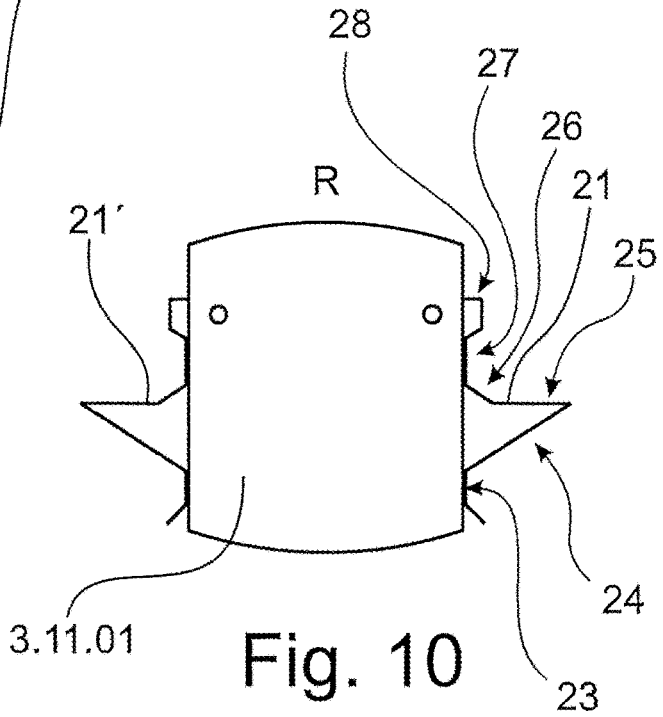
Fig. 10

DEVICE FOR STORING OBJECTS, IN PARTICULAR FOR CURING OBJECTS MADE OF CONCRETE, UNDER DEFINED TEMPERATURE CONDITIONS AND HUMIDITY CONDITIONS

BACKGROUND OF THE INVENTION

Field of the Invention

The invention relates to a device for storing objects under defined temperature conditions and humidity conditions according to the preamble of patent claim 1. In particular, the device is provided for curing objects made of concrete. The objects are, in particular, paving stones, concrete blocks, paving slabs or curbs, which are manufactured in a large number from concrete and after curing should have the same properties such as a substantially identical appearance and a substantially equal strength. This can be achieved during joint curing under defined temperature conditions and humidity conditions. The duration of curing can be shortened, for example, to 24 hours compared to uncontrolled curing objects made of concrete. At the same time, less binder, such as cement, can be used for the concrete, since the existing binder is almost optimally implemented with the adjusted humidity. The objects cured under suitable defined conditions also have a higher strength than uncontrolled cured objects made of concrete.

Description of Related Art

A known such device for curing concrete blocks has a shelving system, provides supply air with defined temperature conditions and humidity conditions and has for this purpose a climate system for providing the supply air and a flow pipe system for distributing the supply air provided in the climate system. The shelving system has a plurality of shelf supports and a plurality of bearing elements for supporting shelves supported on the shelf supports and arranged one above the other in a plurality of levels, wherein the objects to be cured are stored on the shelves.

In this known device, the supply air is distributed in the head region of the shelving system using pipes and led from there through a plurality of vertically arranged pipes of the flow pipe system into the foot region of the shelving system. Exhaust air is extracted in the head region of the shelving system. As a result of the air thus ascending along the shelves arranged one above the other, largely identical temperature conditions and humidity conditions are created at different heights of the shelving system.

A very high humidity is advantageous for the curing of concrete. This leads to a high dew point temperature and consequently to the fact that water from the supply air already condenses on parts of the shelving system, when these parts are only slightly cooler than the supply air. In particular, it has been found that moisture is deposited on the shelf supports in the foot region of the shelving system, that is, in a region in which the shelf supports are bedded in concrete into a base plate. In this region, the shelf supports are traditionally cooler than in higher regions of the shelving system.

The shelf supports are indeed usually galvanized, whereby a shielding effect and additional active corrosion protection is provided by acting as a sacrificial anode. Nevertheless, the permanent exposure of moisture results in a shortened service life of the corrosion protection and thus the risk of corrosion on the shelf supports, which are carrying parts of the shelving system.

BRIEF SUMMARY OF THE INVENTION

The invention has for its object of also protecting the shelf supports from corrosion on their feet for a long period of time and thus to increase the service life of the shelving system.

The invention achieves this object using a device for the storage of objects under defined temperature conditions and humidity conditions according to patent claim 1. Further advantageous embodiments of the invention are specified in the subclaims.

In a device for the storage of objects, in particular for curing objects made of concrete, under defined temperature conditions and humidity conditions, having a shelving system having a plurality of shelf supports and having a plurality of bearing elements for supporting shelves supported on the shelf supports and arranged one above the other in a plurality of levels on which the objects are stored, the invention provides that a flow pipe system for distributing supply air provided in a climate system is at least partially integrated into the shelving system, wherein a plurality of shelf supports at least in sections at the same time are downward pipelines of the flow pipe system that the provided supply air is able to flow through.

The invention has first recognized that an improved corrosion protection is provided when the shelf supports are also kept above the dew point temperature in the foot region of the shelving system. Furthermore, the invention has recognized that an increase in the temperature of all shelf supports in the foot region of the shelving system is achieved when the supply air is led in close distances to the ground and there heats the base plate over a large area.

Furthermore, the invention has recognized that shelf supports are also heated in the foot region, when the supply air is led through said shelf supports and that at the same time the base plate is heated so evenly that adjacent shelf supports, through which no supply air is led, also assume a temperature above the dew point temperature. In particular, the invention utilizes the shelf supports present at tight distances as pipelines for the supply air, which is led with the flow pipe system into the foot region of the shelving system.

The shelf supports in this case are arranged so tightly that it is sufficient and is preferably provided to use only every second shelf support as a pipeline of the flow pipe system. The shelf supports, through which the supply air flows, are heated directly. The shelf supports through which the supply air does not flow are located so tightly to shelf supports through which supply air flows that a sufficient heating of all shelf supports also takes place in the foot region of the shelving system. In particular, each shelf support that supply air does not flow through has at least one adjacent shelf support, which is at the same time a pipeline of the flow pipe system and is therefore heated by the supply air and also sufficiently heats the adjacent shelf support. At the edges of the shelving system, the supply air preferably flows through each shelf support or other support and thus at least in sections at the same time a pipeline of the supply air pipe system. As a result, a sufficient heating of the base plate is ensured even in the edge regions of the shelving system. Shelf supports through which supply air flows and shelf supports which are not part of supply air pipe system are arranged like a checkerboard between the edges.

The service life of the device increases thanks to the invention. At the same time, even more uniform conditions, in particular for the curing of concrete, are created at the individual placement spaces for the objects in the shelving system, which again increases the quality, in particular the compressive strength, abrasion resistance and color uniformity of the cured objects made of concrete. The objects made of concrete are in particular paving stones, concrete blocks, pavement slabs or curbs.

All shelf supports of the shelving system are preferably manufactured from galvanized steel. At least the shelf supports, which at least in sections at the same time are downwards pipelines of the flow pipe system through which the provided supply air is able to flow, preferably each have a C-profile having an open side. Preferably, this open side, at least in the sections in which the respective shelf support is at the same time a pipeline of the flow pipe system, is closed by means of a cover element. The cover element is preferably a sheet metal profile, in particular a galvanized sheet metal profile. The C-profile thus ensures together with the cover element that the pipeline of the flow pipe system is circumferentially closed. The supply air is preferably fed to the shelf supports through separate pipelines, which are laid approximately at the level of the carrier elements.

In a particularly preferred embodiment of the invention, it is provided that the flow pipe system has a plurality of supply air openings for blowing the supply air from the flow pipe system, said supply air openings arranged in the foot region of the shelving system and each formed in a shelf support. In particular, such a supply air opening is provided at the foot of each shelf support, said supply opening in particular being formed to allow the supply air to flow on a base plate on which the shelving system is constructed. The supply air flowing out of the supply air openings is in particular heated and therefore heats the base plate.

The supply air openings preferably each have an adjustable opening width. As a result, adjustments can be made after the first commissioning of the device in order to achieve a distribution of the supply air which leads to a uniform temperature and humidity in all regions of the shelving system.

The shelving system advantageously has a plurality of carrier elements which connect the shelf supports in the head region of the shelving system. The carrier elements are preferably all manufactured from galvanized steel. Particularly preferably, it is further provided that a return pipe system for returning exhaust air is at least partially integrated into the shelving system. A plurality of carrier elements are at the same time from the exhaust air throughflow pipes of the return pipe system. In particular, the air is conducted through the room in which the shelving system is located. The air in this case is blown as supply air through the flow pipe system into the room and extracted from the room as exhaust air through the return pipe system. After appropriate treatment of the exhaust air, thus after adjusting the temperature and preferably also the humidity, the extracted exhaust air is fed back as supply air to the flow pipe system. Optionally, a further exhaust air device for extracting exhaust air into the environment is provided.

Preferably, at least the carrier elements, which are at the same time pipelines of the return pipe system through which exhaust air can flow, each have a C-profile having an open side. Advantageously, this open side is closed at least in the sections in which the respective carrier element is at the same time a pipeline of the return pipe system by means of a cover element. The cover element is preferably a sheet metal profile, in particular a galvanized sheet metal profile. The conduction of air of the exhaust air in the carrier elements takes place in particular according to the conduction of air of the supply air in the shelf supports.

The return pipe system, according to an advantageous embodiment of the invention, has a plurality of exhaust air openings arranged in the head region of the shelving system for sucking in the exhaust air into the return pipe system. The exhaust air openings are arranged in particular in the open sides of the carrier elements following a respective cover element. Preferably, a supply air opening is arranged on every second shelf support in the foot region and an exhaust air opening arranged in the head region of every second shelf support which is a shelf support without supply air opening. As a result, a densely-meshed network of supply air openings and exhaust air openings and a largely uniform directed upward flow distributed over the surface of the shelving system is provided past the shelves.

The device according to the invention having the flow pipe system partially integrated into the shelving system can also be used as a conventional shelving system, without the flow pipe system being supplied with supply air or being able to be supplied, in particular without the flow pipe system being part of a climate system. The device according to the invention can also be combined with an existing climate system or with parts of an existing heating system, if necessary also when required. Preferably, however, it is provided that the device for storing objects also has the climate system.

The climate system preferably has at least one air conditioning unit for providing the supply air having a creatable temperature or for providing the supply air having a creatable temperature and having a creatable humidity. The air conditioning unit is preferably fed the exhaust air in whole or in part on the input side from the return pipe system. The air conditioning unit is preferably formed to heat the supply air and optionally to moisten it. Advantageously, the air conditioning unit is also formed to dehumidify the supply air. Alternatively or additionally, the air conditioning unit is also formed to cool the supply air. Thus, the air conditioning unit can provide the supply air with a respectively desired temperature and humidity. The different functionalities for air conditioning in this case are either structurally distributed over a plurality of devices or consolidated in whole or in part in at least one air conditioning unit.

The climate system preferably has a controller which controls the at least one air conditioning unit in such a way to keep the temperature and humidity in the region of the shelving system in a predetermined range by means of the temperature and humidity of the supply air. For this purpose, preferably at least one temperature sensor and at least one moisture sensor are provided in the region of the shelving system. The sensors provide the controller with measured values. The controller controls the air conditioning unit based on these measured values. In particular, the climate system is formed for maintaining a temperature in the region of the shelving system in a range between 20° C. and 40° C., in particular between 30° and 40°. Advantageously, the climate system is also formed for maintaining a humidity in the region of the shelving system of more than 40%, preferably more than 60%, more preferably more than 90%, in particular in a range of 94% to 97% or 95% to 96%. Corresponding climate values have proven particularly suitable for curing concrete. An alternative embodiment of the invention eliminates the moisture control including the humidity sensor.

Particularly preferably, the device according to the invention is formed for curing concrete. The objects to be stored in the shelving system consist of concrete or have concrete.

For example, shelves are placed in storage in the shelving system with concrete blocks shortly after the manufacture of the concrete blocks, where the concrete blocks, thanks to the climate provided by the invention, cure within a short time so far that they can be removed again after 24 hours from the shelving system and, for example, can be shot peened in a further treatment. Immediately afterwards, the shelving system can already be refilled with further objects made of concrete to be cured. The climate is almost permanent in the region of the shelving system, which in principle favors corrosion. Thanks to the invention, however, the formation of dew at the feet of the shelf supports is effectively counteracted, so that an advantageously extended service life and useful life of the shelving system is achieved.

The shelving system preferably has a steel substructure. The shelf supports are supported on said steel substructure. The steel substructure in this case is preferably cast in a base plate. The base plate is cast in particular of floating screed. The shelf supports protrude from the base plate. Before the base plate is cast, the steel substructure is leveled to later achieve a horizontal alignment of the shelves.

In a preferred embodiment of the invention, it is provided that rails are fastened on the steel substructure. Carriages for the transport of the shelves to be supported on the bearing elements with the objects to be stored in the shelving system can travel on these rails. The rails should be oriented horizontally. Thanks to the fastening of the rails on the steel substructure, the rails are necessarily oriented horizontally when the steel substructure is oriented horizontally. It thus only needs to be leveled once. The rails are preferably fastened on the steel substructure by means of clamps.

Conventionally, known bearing elements are suspended for supporting shelves in known shelf supports, which for this purpose have a plurality of holes. In an advantageous embodiment of the invention, however, it is provided that the bearing elements according to the invention for supporting the shelves are tightly screwed to the shelf supports. The shelf supports in this case are preferably closed at least in sections, on which sections the bearing elements rest, thus formed without holes for suspending bearing elements. As a result, the shelf supports can be used particularly advantageously as pipelines through which the supply air is able to flow through without supply air being able to escape through such holes.

Particularly preferably, the bearing elements are tightly screwed to the shelf supports with thread-forming screws. In particular, the screws do not cut into the shelf supports. As a result, the surface of the shelf supports coated with zinc or a zinc compound is retained, so that the corrosion protection on the shelf supports is retained even in the regions in which the screws are screwed in.

The bearing elements are advantageously made of strip galvanized steel. In particular, the bearing elements are galvanized by means of a magnesium-zinc coating. Such a coating is commercially available, for example, under the trade name "Magnelis". The corrosion protection is further improved with this coating, in particular in the region of the thread formed in the shelf supports. All other parts made of steel of the shelving system, in particular the shelf supports, the carrier elements and the screws, are advantageously piece-galvanized.

In a particularly preferred embodiment of the invention, the bearing elements have a specially developed shape which allows the bearing elements to carry high loads on the shelves. In particular, it is provided that the bearing elements each consist of a multi-angled sheet metal. This sheet advantageously has an upper contact surface, through which the bearing element is tightly screwed to the shelf supports, and a lower contact surface, through which the bearing element is also tightly screwed to the shelf supports. The contact surfaces lie flat against the mounted bearing elements on the sides of the shelf supports. In this case, the bearing elements for the shelf supports are each tightly screwed to two heights on the shelf supports.

More preferably, the sheet, which forms the bearing element, has a flat bearing surface for a shelf between the upper contact surface and the lower contact surface. The shelf is preferably a board, in particular a wooden board. Advantageously, the angled plate further has an inclined support surface which connects the bearing surface to the lower contact surface. As a result, the support surface is advantageously supported in the region of an outer edge of the bearing element. More preferably, the angled sheet has an oblique connection surface which connects the bearing surface to the upper contact surface. The oblique connection surface increases obliquely from the flat bearing surface to the upper contact surface. A chamfer is preferably provided above the upper contact surface for maintaining space of a shelf placed on the respective bearing element from the shelf support. The bearing element is again angled several times in the region of the chamfer. The chamfer effectively counteracts tilting of the shelves when loading the shelving system. As a result, the shelf supports, the bearing elements and the shelves are protected from damage, which could cause tilted shelves through collision with the shelving system. A thus less frequent occurrence of damage minimizes production interruptions and reduces costs. The chamfer is formed and arranged such that each customary shelf, in particular having a thickness in the range of 10 mm to 60 mm, is located at least partially at the level of the respective chamfer during loading. Thanks to the chamfers, screw heads of the screws are also protected against contact with the shelves, by means of said screws the shelf supports are tightly screwed in the region of the upper contact surface, in particular when laying the shelves on the bearing elements.

BRIEF DESCRIPTION OF THE DRAWINGS

Further embodiments are apparent from the claims, from the drawings and from the following description of an embodiment of the invention represented in the drawings. The drawings show:

FIG. 8: parts of the device of FIG. 1 in a side sectional view;

FIG. 9: an enlarged view of the region marked "S" in FIG. 8; and

FIG. 10: an enlarged view of the region marked "R" in FIG. 9.

DETAILED DESCRIPTION OF THE INVENTION

Figure 1:
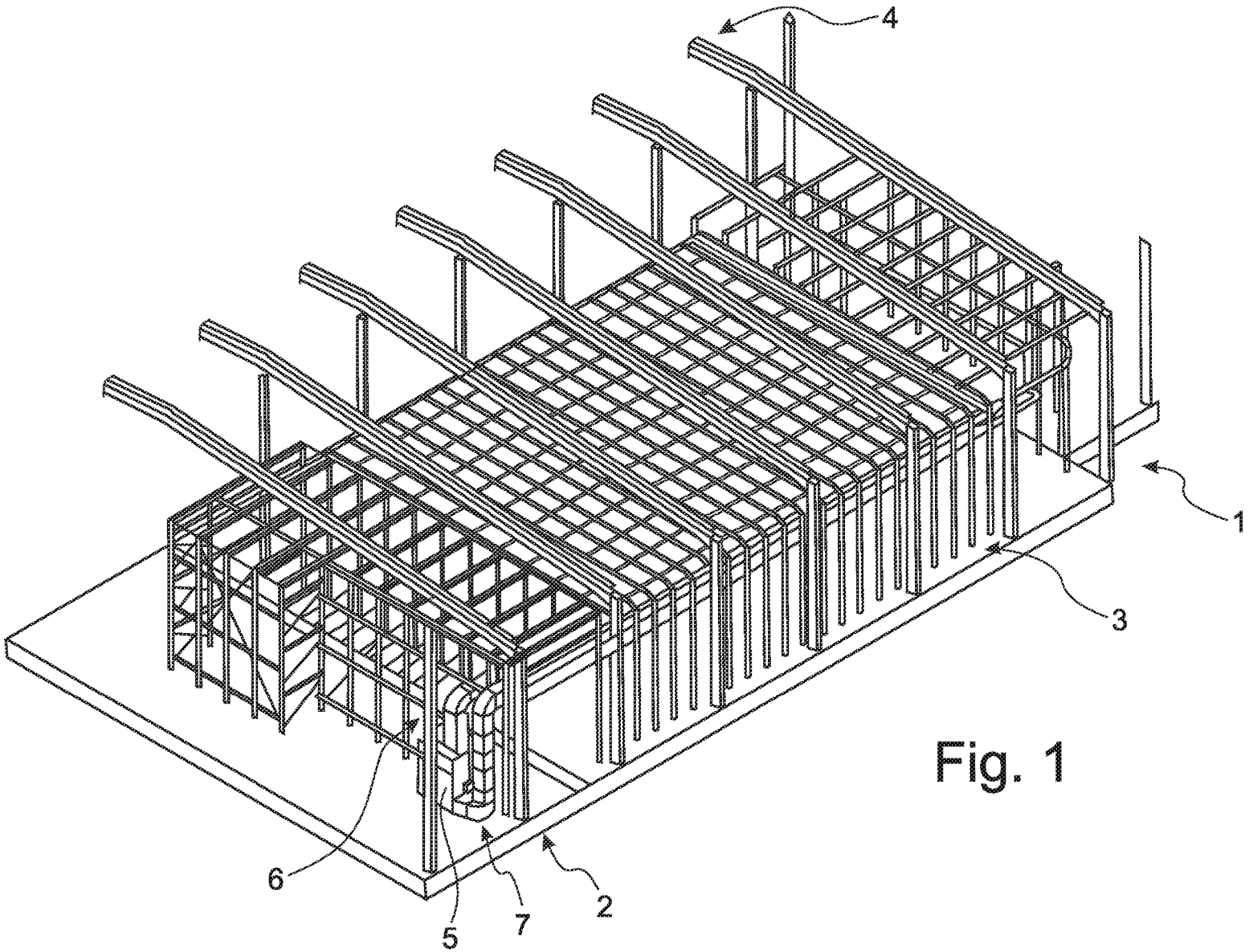
FIG. 1: a device according to the invention for curing objects made of concrete having a shelving system and a climate system according to an embodiment of the invention in a perspective view.
Figure 2:
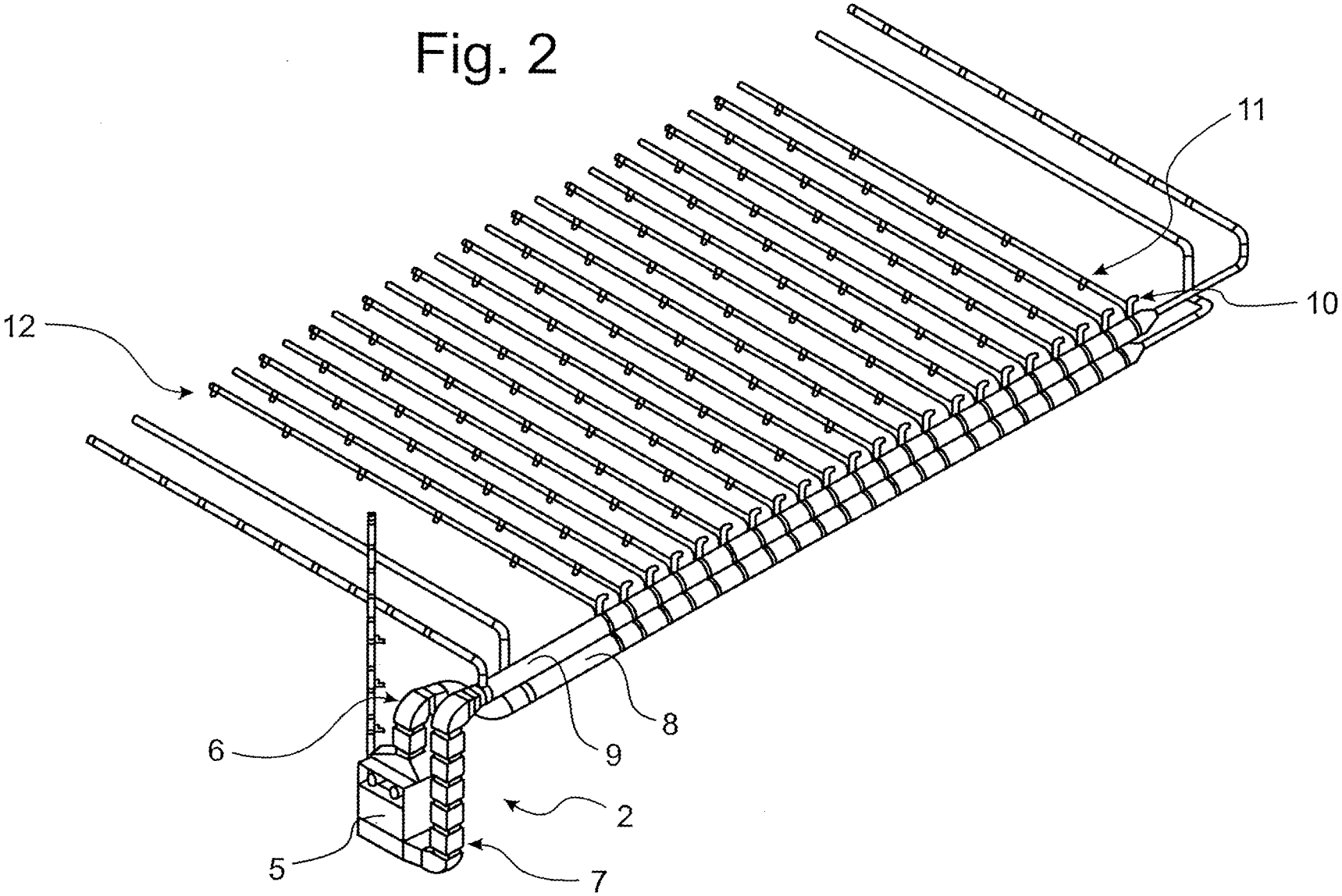
FIG. 2: parts of the climate system of the device of FIG. 1 in perspective view.

FIG. 1 shows a device according to the invention for the storage of objects under defined temperature conditions and humidity conditions, in particular for curing objects made of concrete. The device has a shelving system 1 and a climate system 2. Parts of the climate system 2 are also shown isolated in FIG. 2. The viewing direction in FIG. 2 is identical to the viewing direction in FIG. 1. The shelving system 1 has, in a region provided for the storage of objects, in the rear two rows of twenty-two columns each ten rows of twenty-two shelf supports each, which are referred to in FIG. 1 collectively by the reference numeral 3. The shelf supports 3 are used to support a plurality of shelves, which are not shown for reasons of clarity in the drawings. Further supports of the shelving system are provided in the lateral edge regions of the device which supports, however, like the supports 3 in the front two rows, do not support shelves. Cross braces for stabilizing shelving system 1 are located on the shelf supports or supports in the edge regions of said shelving system 1. In the head region of the shelving system 1, carrier elements for connecting the supports and shelf supports 3 are provided transversely to the rows in which the supports and shelf supports 3 are arranged, said carrier elements designated in FIG. 1 by the reference numeral 4.

In the embodiment according to FIG. 1, a passage is arranged at both end faces of the rows of shelves, from which at least one carriage having shelves either for loading the shelves or for removing the shelves can move into the desired row. A time advantage arises during loading by loading from a passage and removal of the shelves to the passage on the opposite end face of the shelving system 1. In an embodiment according to the invention alternative to the embodiment shown, however, a passage is provided on only one end face of the shelving system 1, from which passage the shelves are fed for loading and through which the shelves having the cured objects leave the shelving system 1 again. This results in a smaller footprint of the shelving system 1 and cost advantages arise with the shelving system. 1

The climate system 2 has an air conditioning unit 5 that draws in air through a return pipe system 6 and provides it with a desired temperature and desired humidity in a flow pipe system 7. The return pipe system 6 has a return collection channel 8. The flow pipe system 7 has a flow collection channel 9. The collection channels 8 and 9 extend in the head region of the shelving system 1 along the first two rows with the supports 3 of the shelving system 1. Numerous return collection channel connections 10 are provided on the return collection channel 8, by means of said return collection channel connections the carrier elements 4 are connected to the return collection channel 8. A flow distribution pipe 11 is arranged in each case parallel to each carrier element 4 and connected to the flow collection channel 9. Each flow distribution pipe 11 has in each case five or six flow distribution pipe connections 12, by means of which the flow distribution pipes 11 are connected in total to every second shelf support 3 and to every second support 3 in the second row. The flow distribution pipe connections 12 in this case are arranged offset from one another in such a way that in every row of the shelving system 1 with shelf supports 3 every second shelf support 3 and transverse to the rows along the respective flow distribution pipe 11, every second shelf support 3 is also connected to the flow pipe system 7.

Figure 3:
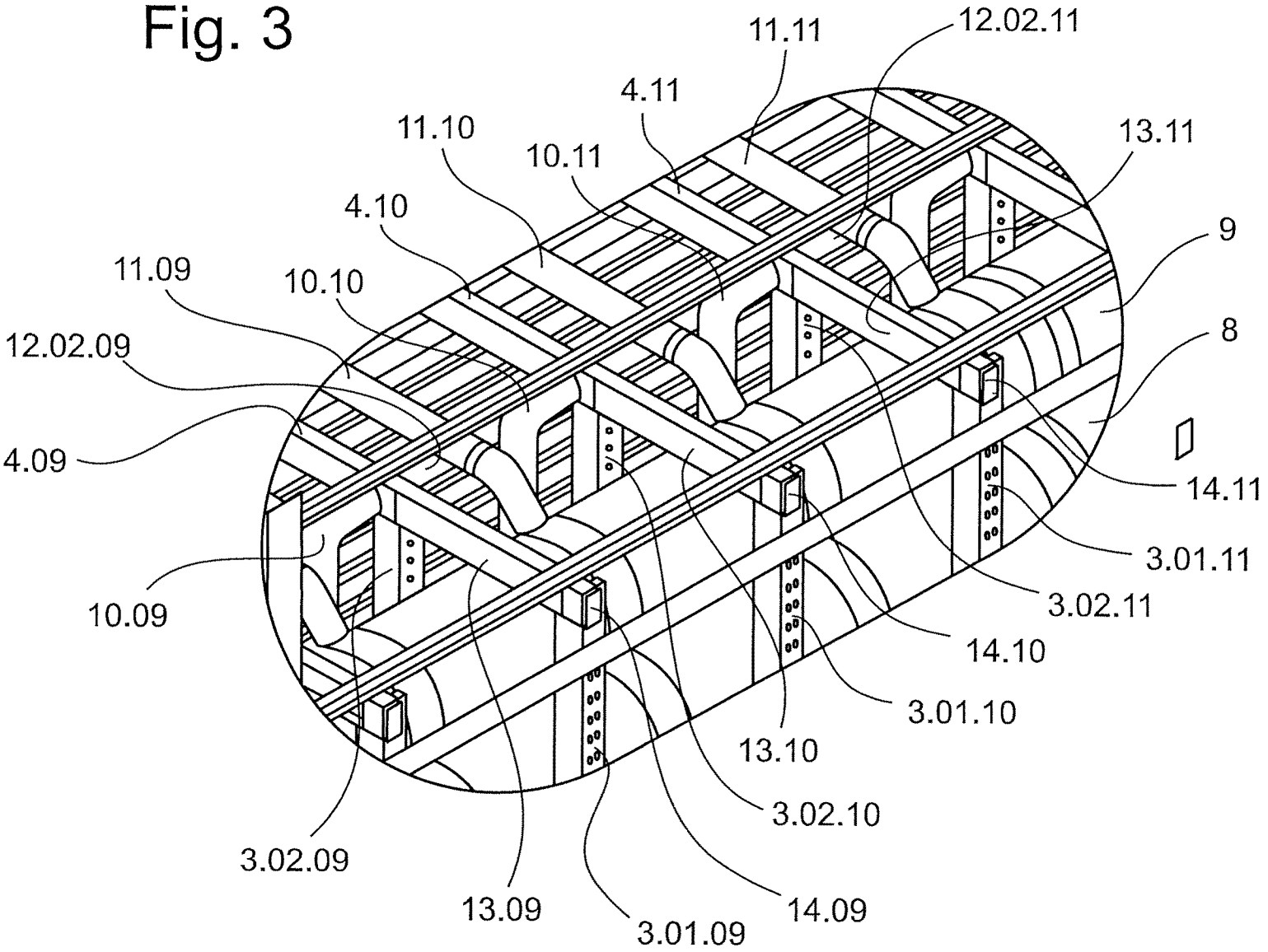
FIG. 3: a first section of the device according to the invention from FIG. 1 in perspective view.
Figure 4:
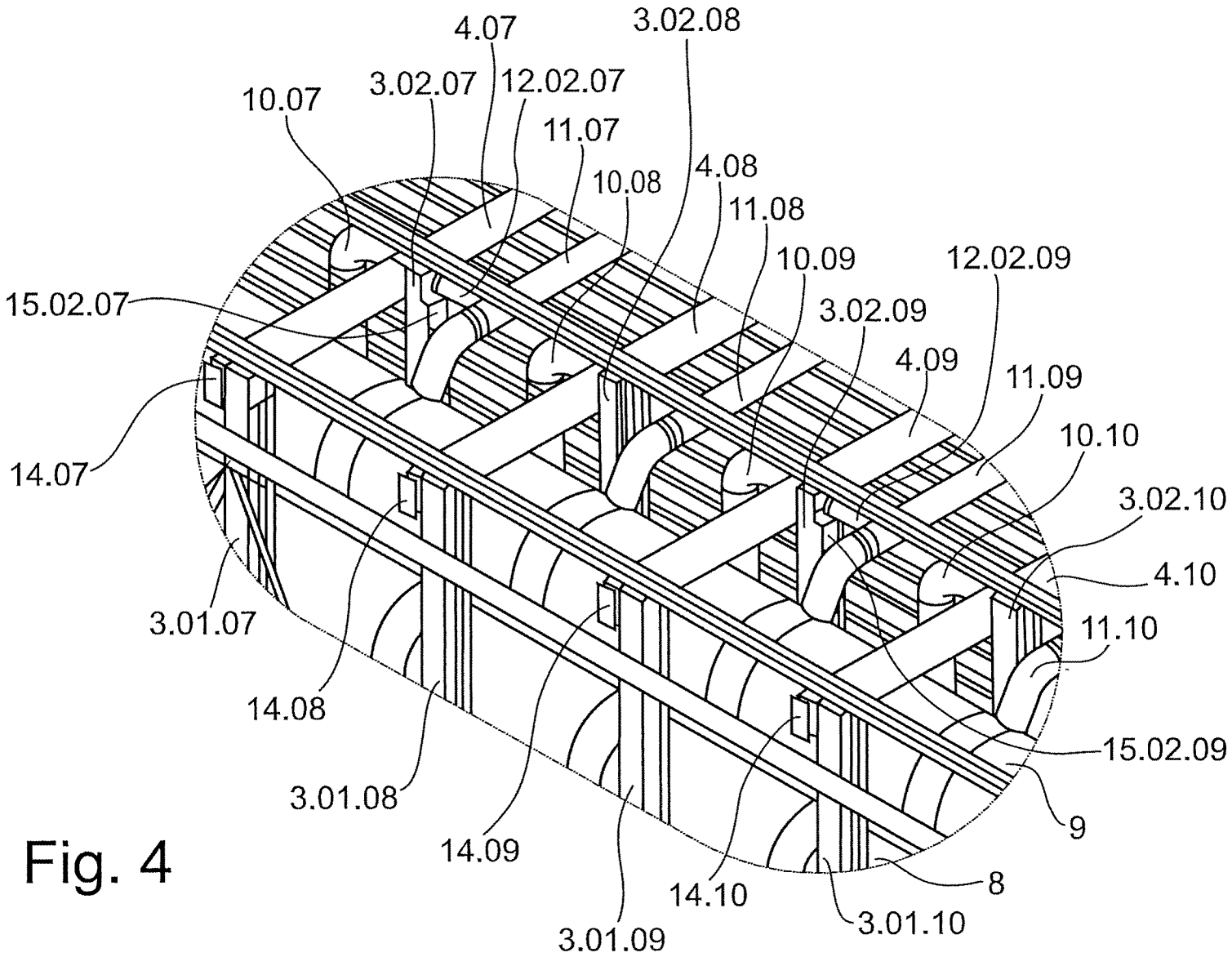
FIG. 4: a second section of the device according to the invention from FIG. 1 in perspective view.
Figure 5:
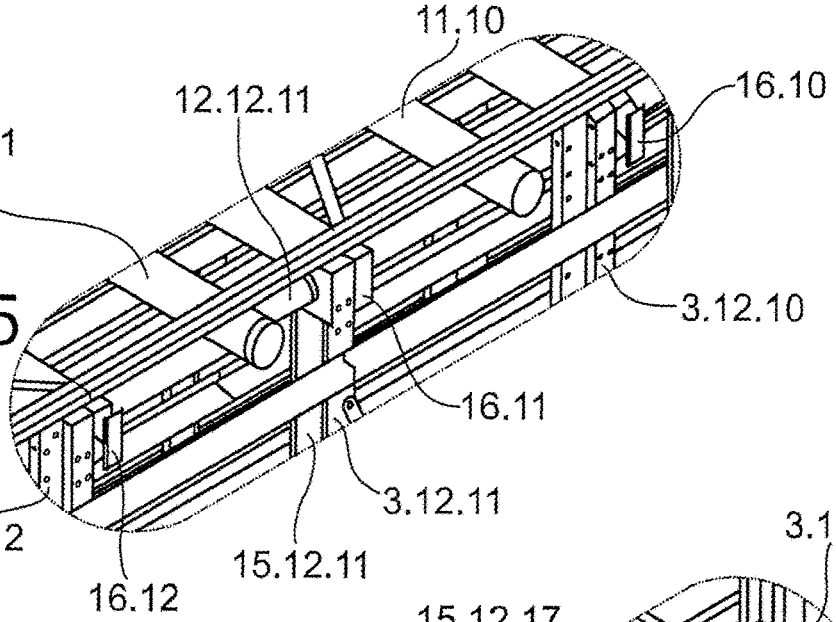
FIG. 5: a third section of the device according to the invention from FIG. 1 in perspective view.

FIGS. 3, 4 and 5 illustrate parts of the device enlarged from different viewing directions. In FIG. 3, the viewing direction coincides with the viewing direction of FIGS. 1 and 2. In FIG. 4, the viewing direction is rotated by 90° with respect to FIGS. 1 to 3. In FIG. 5, the viewing direction is rotated by 180° with respect to FIGS. 1 to 3. For individual designation of the supports and shelf supports 3 visible in the figures, the reference numeral separated by a dot is a number of the row in which the respective support or shelf support 3 is arranged, and a number in the respective row is readjusted by a further point. FIG. 3 shows a section with the supports 3.01.09, 3.01.10, 3.01.11, 3.02.09, 3.02.10 and 3.02.11 with this notation. A number separated by a dot is added to the carrier elements 4, return collection channel connections 10 and flow distribution pipes 11 for individual designation, said number corresponding to the last number part of the associated support or shelf support 3. The flow distribution pipe connections 12 are marked individually according to the supports 3. Like reference numerals designate the same parts throughout these figures. The support 3.02.09 is connected to the flow distribution pipe 11.09 via the flow distribution pipe connection 12.02.09. In the same second row, the support 3.02.11 is connected to the flow distribution pipe 11.11 through the flow distribution pipe connection 12.02.11. Thus, the supports 3.02.09 and 3.02.11 are parts of the flow pipe system 7 of the climate system 2. The support 3.02.10 arranged between the supports 3.02.09 and 3.02.11, however, is not connected to the flow collection channel 9 and therefore not part of the flow pipe system 7.

The carrier elements 4 are all parts of the return pipe system 6 and connected to the return collection channel 8 via the return collection channel connections 10. The carrier elements 4 in this case are C-profiles, which are closed by cover element 13. Three cover elements 13 are individually designated in FIG. 3 with the reference numerals 13.09, 13.10 and 13.11. In the crossing region with the supports 3 or shelf supports 3 which are not part of the flow pipe system 7, the carrier elements 4 each have an exhaust air opening, wherein an exhaust air opening is each provided in the rows and from row to row in the region of every second shelf support 3, in particular distributed like a checkerboard. Edge exhaust air openings are realized by means of first end caps 14, in particular first end caps 14.09, 14.10 and 14.11, at the ends of the carrier elements 4.

FIG. 4 shows a detail of the device according to the invention, which again shows part of the detail shown in FIG. 3 from another perspective. In particular, upper sections of the supports 3.01.09, 3.01.10, 3.02.09 and 3.02.10 are also illustrated in FIG. 4. In addition, the detail shown in FIG. 4 shows upper sections of the supports 3.01.07, 3.01.08, 3.02.07 and 3.02.08. Also, the first end caps 14.07 and 14.08 are open and each have the function of an edge exhaust air opening. No exhaust air openings are arranged in the region of the supports 3 of the second row.

At least the supports 3, which are part of the flow pipe system 7, that is, in particular the supports 3.02.07 and 3.02.09 each have a cover element 15, which is individually designated on the support 3.02.07 with 15.02.07 and on the support 3.02.09 with the reference numeral 15.02.09.

FIG. 5 shows a detail with end regions of the flow distribution pipes 11.10 and 11.11. The flow distribution pipe 11.11 is connected to the shelf support 3.12.11 via the flow distribution pipe connection 12.12.11 so that supply air from the flow distribution pipe 11.11 can flow into the cavity formed by the shelf support 3.12.11 and covered by means of the cover element 15.12.11. As an alternative to the embodiment shown, all shelf supports 3.12 which are arranged at the edge of the shelving system 2, at the same time are also part of the flow pipe system 7 and lead supply air into the region near the bottom of the shelving system 1. The carrier elements 4 are mechanically connected to the shelf supports 3 of the last row. Second end caps 16 are arranged at the ends of the carrier elements 4. In this case, the second end cap 16.11 in the region of the shelf support 3.12.11, which is part of the flow pipe system 7, is closed. The second end caps 16.10 and 16.12, which are arranged in the region of the shelf supports 3.12.10 and 3.12.12, are open and each form an edge exhaust air opening. As an alternative to the embodiment shown, all end caps 16 are opened and each form an edge exhaust air opening. As a rule, that is, for example, with the exception of the first two rows shown according to FIGS. 3 and 4, a shelf support 3 is always in alternation at the same time a downward directed pipeline of the flow pipe system 7 or arranged adjacent to an exhaust air opening of the return pipe system 6.

Figure 6:
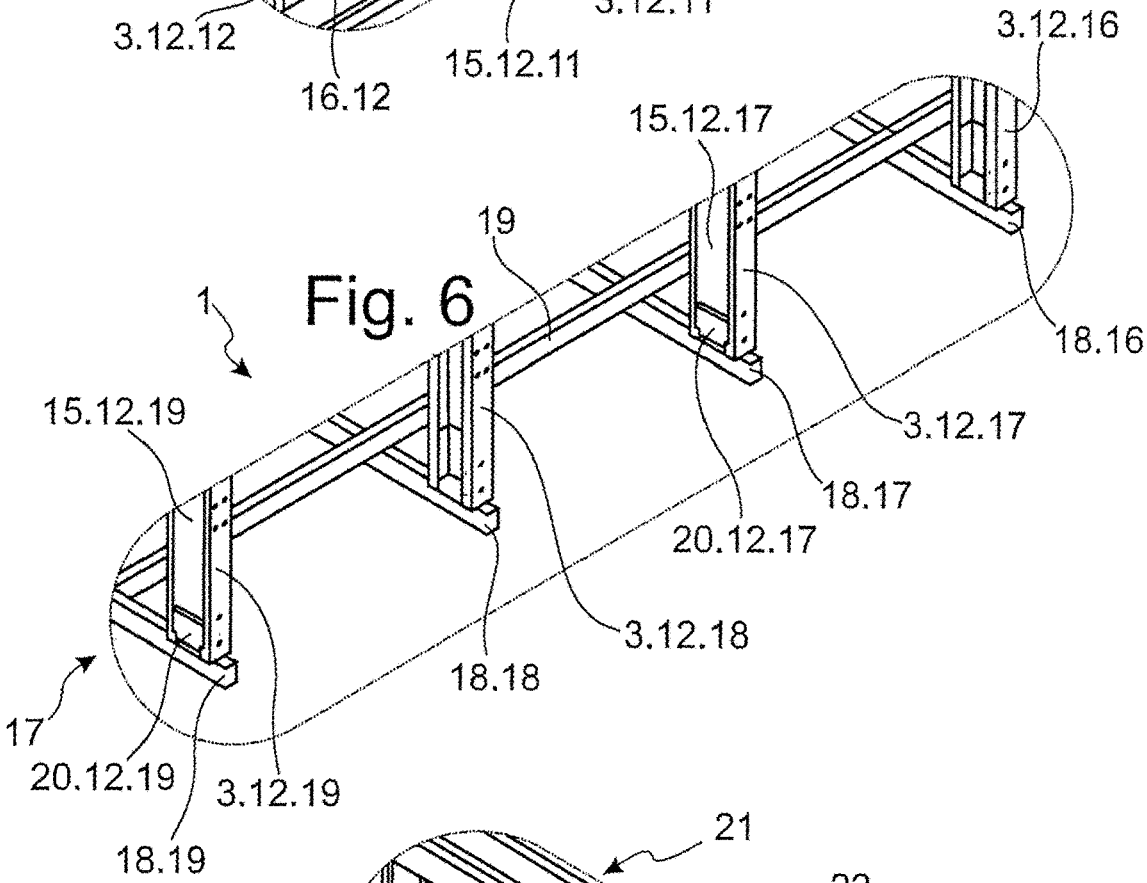
FIG. 6: a fourth section of the device according to the invention from FIG. 1 in perspective view.

FIG. 6 shows a detail of the shelving system 1 in the foot region with the shelf supports 3.12.16, 3.12.17, 3.12.18 and 3.12.19. The viewing direction is the same as that of FIG. 5. The shelf supports 3 are not yet bedded in concrete in a base plate here. Therefore, a steel substructure 17 is visible in FIG. 6, which consists of a plurality of carrier rails 18 arranged parallel to each other and transverse to the alignment of the rows, of which the carrier rails 18 visible in FIG. 6 are designated by the reference numerals 18.16, 18.17, 18.18 and 18.19. Running rails 19 are preferably arranged pairwise on the carrier rails 18 between the rows of shelves and transversely to the orientation of the carrier rails 18. The running rails 19 are fastened on the carrier rails 18 by means of clamps. Carriages can be moved on the running rails 19 to load the shelving system 1.

The shelf supports 3.12.17 and 3.12.19 are further formed by means of the cover elements 15.12.17 and 15.12.19 to pipes in which the supply air flows downward and can flow out through supply air openings 20, which are individually designated here by the reference numerals 20.12.17 and 20.12.19. The supply air openings 20 can be adjusted, wherein the throughput of supply air is adjusted by the supply air openings 20. The shelf supports 3 are fastened by means of angle plates and screw connections on the steel substructure 17. After the construction and alignment of the shelving system 1, the substructure 17 is cast into a base plate and is therefore no longer visible during operation of the shelving system 1. The entire steel substructure 17 and the running rails 19 are bedded with concrete by casting the base plate. The base plate thus produced counteracts a bending of the running rails 19, even when there is a carriage for loading the shelving system 1 on these rails 19.

The carriage is in particular a loading device and can have a weight of several tons. The carriage preferably carries at the same time all shelves that are to be arranged one above the other in a section of the shelving system 1. All these shelves are stored at the same time on the bearing elements 21 provided for this purpose. After curing of the objects, all shelves respectively arranged one above the other are raised together again and moved with the carriage to one end of the respective passage. Preferably, after this, shelves having objects to be cured are again moved by means of the carriage into the region with the now free-standing bearing elements 21 and placed on these shelves. This is preferably done fully automatically.

Figure 7:
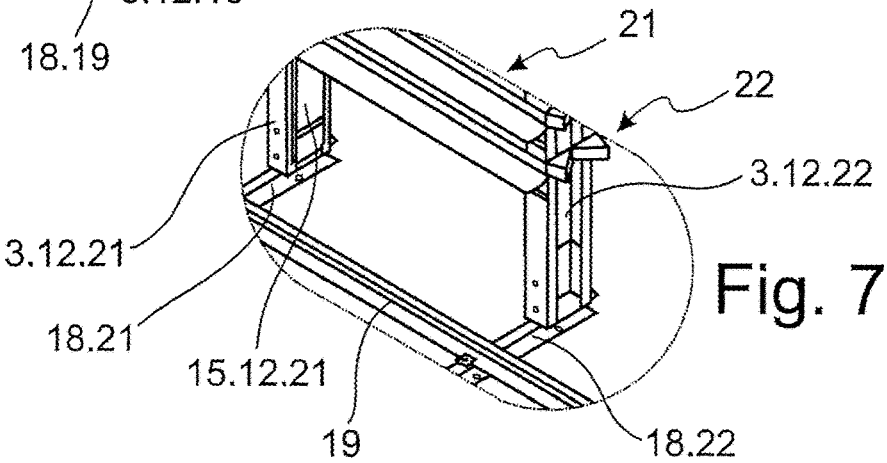
FIG. 7: a fifth section of the device according to the invention from FIG. 1 in perspective view.

FIG. 7 shows a detail similar to the detail of FIG. 6, wherein, however, bearing elements 21 are fastened to the shelf supports 3.12.21 and 3.12.22 by means of screw connections. Centering aids 22, in particular board centering, center shelves on the shelf support 3.12.22, which shelves are to be placed on the bearing elements 21, when retracting.

A plurality of bearing elements 21 can be seen in the sectional view of the device according to the invention having the shelving system 1 and the climate system 2 according to FIG. 8. A detail designated "S" from the illustration of FIG. 8 is illustrated enlarged in FIG. 9.

A detail designated "R" having two identical bearing elements 21 in FIG. 10, of which to distinguish bearing elements only a first bearing element is designated by reference numeral 21 and the second bearing element by the reference numeral 21', is shown enlarged again. Each bearing element 21, 21' is a multi-angled and galvanized steel sheet, which has from bottom to top next to each other a not further designated slope, a lower contact surface 23 adjoining the slope in an edge, an oblique support surface 24, a planar bearing surface 25, an oblique connection surface 26, an upper contact surface 27 and a chamfer 28. The chamfer 28 has an oblique surface, which is aligned parallel to the oblique support surface 24. The chamfer 28 subsequently has a vertical surface, which is arranged parallel to the contact surfaces 23 and 27, and a horizontal surface, which is arranged parallel to the planar bearing surface 25.

All the features mentioned in the preceding description and in the claims can be combined in any selection with the features of the independent claim. The disclosure of the invention is therefore not limited to the described and/or claimed combinations of features, but rather all feature combinations meaningful in the context of the invention are to be regarded as disclosed.

The invention claimed is:

1. A device for curing objects made of concrete under defined temperature conditions and humidity conditions, comprising:

a shelving system constructed on a cast base plate, wherein the shelving system has' comprises:

a plurality of shelf supports manufactured from galvanized steel and protruding from the base plate;

a plurality of bearing elements for supporting shelves supported on the shelf supports and arranged one above the other in a plurality of levels, on which the objects are stored; and a plurality of centering aids for centering shelves on the shelf supports;

a climate system having at least one air conditioning unit for providing supply air at an adjustable temperature, the at least one air conditioning unit being configured to heat the supply air;

a flow pipe system for distributing the supply air provided in the climate system; and a return pipe system for returning exhaust air to the climate system, the exhaust air from the return pipe system being in whole or in part fed to the air conditioning unit on an input side, wherein the flow pipe system is at least partially integrated into the shelving system, wherein a plurality of shelf supports are pipelines of the flow pipe system through which the provided supply air can flow downwards, at least in sections, at the same time and which lead the supply air in close distances into a foot region of the shelving system for heating the shelf supports in the foot region and for heating the base plate over a large area, the flow pipe system has a plurality of supply air openings for blowing the supply air from the flow pipe system, the supply air openings are arranged in the foot region of the shelving system and being formed to allow the supply air to flow on the base plate and each of the supply air openings is formed in a shelf support.

2. The device according to claim 1, wherein at least the shelf supports, which are pipelines of the flow pipe system through which the provided supply air can flow downwards, at least in sections, at the same time, have a C-profile having an open side, wherein said open side at least in the sections in which the respective shelf support at the same time is a pipeline of the flow pipe system, is closed, by means of a cover element, in particular by means of a sheet metal profile.

3. The device according to claim 1, wherein the shelving system is constructed on the base plate, wherein the shelf supports are protruding from the base plate, wherein the shelf supports through which the supply air flows are directly heated and wherein the supply air led into the foot region of the shelving system heats the base plate over a large area.

4. The device according to claim 1, wherein the supply air openings each have an adjustable opening width.

5. The device according to claim 1, wherein the return pipe system is at least partially integrated into the shelving system, wherein a plurality of carrier elements, which connect the shelf supports to each other in a head region of the shelving system at the same time are pipelines of the return pipe system that the exhaust air is able to flow through.

6. The device according to claim 5, wherein at least the carrier elements, which at the same time are pipelines of the return pipe system that the exhaust air can flow through, each have a C-profile having an open side, wherein said open side at least in the sections in which the respective carrier element at the same time is a pipeline of the return pipe system, is closed by means of a cover element, in particular by means of a sheet metal profile.

7. The device according to claim 5, wherein the return pipe system has a plurality of exhaust air openings for sucking in the exhaust air into the return pipe system arranged in the head region of the shelving system.

8. The device according to claim 7, wherein each exhaust air opening is assigned in each case to a shelf support which is not at the same time a pipeline of the flow pipe system, and in that the shelf supports, which at the same time are pipelines of the flow pipe system, are arranged, at least in regions, like a checkerboard alternating with the pipelines, to which an exhaust air opening is assigned.

9. The device according to claim 1, wherein each support or shelf support arranged at an edge of the shelving system is a pipeline of the flow pipe system.

10. The device according to claim 1, wherein the at least one air conditioning unit provides the supply air with an adjustable humidity.

11. The device according to claim 10, wherein the climate system has a controller which controls the at least one air conditioning unit in such a way to keep the temperature and humidity in a region of the shelving system in a predetermined range by means of the temperature and humidity of the supply air.

12. The device according to claim 1, wherein the climate system is formed for maintaining a temperature in a region of the shelving system in a range between 20° C. and 40° C. and for maintaining a humidity in the region of the shelving system of more than 40%.

13. The device according to claim 1, wherein the objects to be stored in the shelving system are made of concrete or have concrete.

14. The device according to claim 1, wherein the shelving system has a steel substructure which is cast in a base plate, wherein the shelf supports are supported on the steel substructure, running rails are fastened on the same steel substructure, wherein carriages for transporting the shelves to be supported on the bearing elements having the objects to be stored in the shelving system can move on the running rails.

15. The device according to claim 1, wherein the bearing elements are screwed to the shelf supports with thread-forming screws.

16. The device according to claim 15, wherein each of the bearing elements consists of a multi-angled sheet metal having an upper contact surface through which the bearing element is screwed to the shelf supports, a lower contact surface through which the bearing element is screwed to the shelf supports, a flat bearing surface for a shelf between the upper contact surface and the lower contact surface, an oblique support surface which connects the bearing surface to the lower contact surface, an oblique connection surface which connects the bearing surface to the upper contact surface, and a chamfer above the upper contact surface for maintaining space of a shelf suspended in the respective bearing element from the shelf support.

* * * * *